US006581433B2

(12) United States Patent
Otsuka et al.

(10) Patent No.: US 6,581,433 B2
(45) Date of Patent: Jun. 24, 2003

(54) METHOD OF MANUFACTURING A METAL PIPE WITH AN ECCENTRICALLY EXPANDED OPEN END

(75) Inventors: Masato Otsuka, Amagasaki (JP); Hanji Ishikawa, Amagasaki (JP)

(73) Assignee: Nisshin Steel Co., Ltd. (JP)

( * ) Notice: Subject to any disclaimer, the term of this patent is extended or adjusted under 35 U.S.C. 154(b) by 14 days.

(21) Appl. No.: 09/962,919

(22) Filed: Sep. 24, 2001

(65) Prior Publication Data

US 2002/0073759 A1 Jun. 20, 2002

(30) Foreign Application Priority Data

Sep. 25, 2000 (JP) ..... 2000-290302

(51) Int. Cl.[7] ..... B21D 41/02
(52) U.S. Cl. ..... 72/370.06; 72/370.1
(58) Field of Search ..... 72/306, 370.03, 72/370.06, 370.08, 370.1, FOR 100, FOR 101

(56) References Cited

U.S. PATENT DOCUMENTS 6,260,401 B1 * 7/2001 Tada ..... 72/370.06

* cited by examiner

*Primary Examiner*—Lowell A. Larson
(74) *Attorney, Agent, or Firm*—Webb Ziesenhiem Logsdon Orkin & Hanson P.C.

(57) ABSTRACT

A method of manufacturing a metal pipe with an eccentrically expanded open end comprises the steps of plastically deforming to a coaxially expanded state $M_1$ so that an axial wall length $L_2$ at a side to be eccentrically expanded is longer than an axial wall length $L_1$ at the opposite side to be expanded without eccentricity. The coaxially expanded open end $M_1$ is then plastically deformed to an eccentrically expanded state $M_2$ by forcibly inserting an eccentrically expanding punch into the coaxially expanded open end $M_1$. The eccentrically expanding punch has a boundary between a conical tip and a cylindrical body inclined with a predetermined angle θ so as to bring the cylindrical body into contact with an inner wall of the coaxially expanded open end $M_1$ at a side to be eccentrically expanded earlier than the opposite side to be expanded without eccentricity. When the coaxially expanded open end $M_1$ is plastically deformed to an eccentrically expanded state $M_2$, metal flow is suppressed at a side to, be eccentrically expanded, but metal flow from the opposite side to be expanded without eccentricity to the former side is promoted. Consequently, the open end is plastically deformed to the eccentrically expanded state $M_2$ without any thickness deviation along a circumferential direction.

2 Claims, 2 Drawing Sheets

METHOD OF MANUFACTURING A METAL PIPE WITH AN ECCENTRICALLY EXPANDED OPEN END

BACKGROUND OF THE INVENTION

The present invention relates to a method of manufacturing a metal pipe having an open end expanded eccentrically with respect to its axis.

A metal pipe with an eccentrically expanded open end has been used as an oil supply pipe for a vehicle fuel or the like. To date, such a metal pipe has been manufactured by bulging an open end of an original metal pipe or by connecting a metal pipe with a squeezed open end to another metal pipe with an expanded open end. However, any of these processes is too complicated, resulting in an increased manufacturing cost. In this regard, a different method has been examined, whereby an original metal pipe is radially expanded at its open end by forcibly inserting a tapered expanding punch.

In a conventional expanding method, an expanding punch is forcibly inserted into an original metal pipe 1 with an open end vertical to its axis, as shown in FIG. 1. The open end is plastically deformed to a coaxially expanded state 2 by insertion of the expanding punch. When an expanding punch tapered at its tip is used, a tapered part 4 is formed between a straight part 3 and the expanded open end 2. Thereafter, another punch, which is held at a position shifted or offset from an axis of the straight part 3, is inserted into the expanded open end 2 so as to form an eccentrically expanded open end 5 off centered from the axis of the straight part 3.

Although the eccentrically expanded part 5 is formed by inserting the punch whose center axis is offset a certain distance from the axis of the straight part 3 in a direction D, a deformation ratio of the original metal pipe 1 is varied along a circumferential direction in response to eccentricity. In short, the wall thickness of the original metal pipe 1 is not reduced so much at a side 7 to be expanded without eccentricity, but the original metal pipe 1 is preferentially stretched at a side 6 to be eccentrically expanded along its circumferential direction with less metal flow from the side 7 to the side 6. Consequently, the eccentrically expanded side 6 is thinned along the circumferential direction. The thin wall causes problems, such as cracking or necking, which intensify as the expanding ratio increases. The partially thinned wall also degrades the mechanical strength of a product.

SUMMARY OF THE INVENTION

The present invention provides a metal pipe with an eccentrically expanded open end free from cracks and necking, by formation of a coaxially expanded open end, which is elongated along an axial direction of the metal pipe at a side to be eccentrically expanded longer than the opposite side to be expanded without eccentricity, in prior to an eccentrically expanding step so as to promote metal flow from the former side to the latter side without partial reduction of wall thickness along a circumferential direction.

The present invention provides a new method of manufacturing a metal pipe with an eccentrically expanded open end by two steps of coaxial and eccentric expansion.

A coaxially expanding punch is forcibly inserted into an open end of an original metal pipe, so as to plastically deform the open end to a coaxially expanded state such that a side to be eccentrically expanded is longer than the opposite side to be expanded without eccentricity along an axial direction of said original metal pipe.

After formation of the coaxially expanded open end, the coaxially expanding punch is withdrawn from the metal pipe.

Thereafter, an eccentrically expanding punch, which has a boundary between a conical tip and a cylindrical body inclined with a predetermined angle with a respect to a radial direction of the original metal pipe so that the cylindrical body comes in contact with an inner wall of the coaxially expanded open end at the side to be eccentrically expanded earlier than the opposite side to be expanded without eccentricity, is forcibly inserted into the coaxially expanded open end of the original metal pipe so as to plastically deform the open end to an eccentrically expanded state.

In the coaxially expanding step, a coaxially expanding punch, which has a boundary between a conical tip and a cylindrical body inclined with such an angle that a length of the cylindrical body along an axial direction of the original metal pipe is shorter at the side to be eccentrically expanded than the opposite side to be expanded without eccentricity, may be used. An open end of the original metal pipe is plastically deformed to a coaxially expanded state elongated along its axial direction at a side to be eccentrically expanded as compared with the opposite side to be expanded without eccentricity, by forcible insertion of such the coaxially expanding punch.

Furthermore, when the coaxially expanded open end is worked with an eccentrically expanding punch, which has a boundary between its conical tip and its cylindrical body inclined opposite to inclination of the coaxially expanding punch, metal flow is promoted from the opposite side to be expanded without eccentricity to the side to be eccentrically expanded. Consequently, the open end of the metal pipe is plastically deformed to an eccentrically expanded state without significant reduction of wall thickness along its circumferential direction.

DETAILED DESCRIPTION OF THE INVENTION

According to the present invention, an open end of a metal pipe is expanded by two steps of coaxial and eccentric expansion. In the first step (a coaxially expanding step), the open end is coaxially expanded. In the second step (an eccentrically expanding step), the coaxially expanded open end is further expanded eccentrically.

Figure 1:
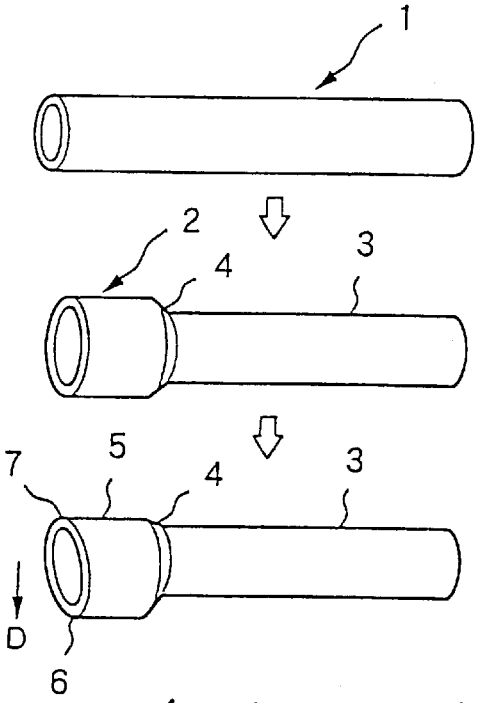
FIG. 1 is a schematic view depicting a conventional prior art method of deforming an open end of a metal pipe to an eccentrically expanded state employing two steps of coaxial and eccentric expansion.
Figure 2A:
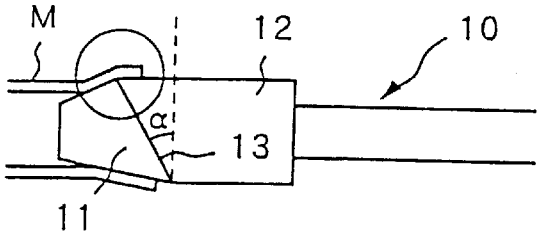
( prior art ) FIG.2A
FIG. 2A is a schematic view depicting the newly proposed method, whereby an open end of an original metal pipe is plastically deformed to a coaxially expanded state having axial wall length at a side to be eccentrically expanded longer than the opposite side to be expanded without eccentricity.
Figure 2B:
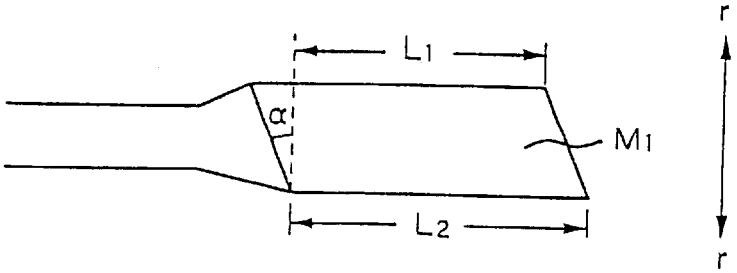
FIG. 2B is a view illustrating a coaxially expanded open end of a metal pipe.

In the coaxially expanding step, a coaxially expanding punch 10, which has a boundary 13 between a conical tip 11 and a cylindrical body 12 inclined with a predetermined angle a with respect to a radial direction r of an original metal pipe M, is held at a position concentric with the original metal pipe M. The coaxially expanding punch 10 is then forcibly inserted into the original metal pipe M, as shown in FIG. 2A. Since an inner wall of the metal pipe M is brought into contact with the cylindrical body 12 of the punch 10 and expanded to an objective diameter at the side to be expanded without eccentricity earlier than the side to be eccentrically expanded, shrinkage deformation of the wall is predominant at the side to be expanded without eccentricity rather than the side to be eccentrically expanded. Consequently, the open end of the original metal pipe M is plastically deformed to the coaxially expanded state $M_1$ such that an axial wall length $L_1$ at the side to be expanded without eccentricity is shorter than an axial wall length $L_2$ at the side to be eccentrically expanded, as shown in FIG. 2B.

The coaxially expanded open end $M_1$ having a wall differentially elongated with $L_1<L_2$ along its axial direction may be formed by various types of punches, as far as plastic deformation of the wall to an objective diameter at the side to be expanded without eccentricity is early to plastic deformation of the wall at the side to be eccentrically expanded.

When a punch 10, which has a boundary between a conical tip 11 and a cylindrical body 12 inclined with an angle α, is used for expansion of an open end of an original metal pipe M, the inclination angle α is preferably determined at 3–60 degrees. If the inclination angle α is below 3 degrees, a difference suitable for the purpose is not sufficiently realized between the axial wall lengths $L_1$ and $L_2$. If the inclination angle α is above 60 degrees, metal flow out of the side to be expanded without eccentricity is too intensified in the following eccentrically expanding step. The excessive metal flow means reduction of wall thickness and causes defects such as cracking at the side to be expanded without eccentricity.

Figure 3A:
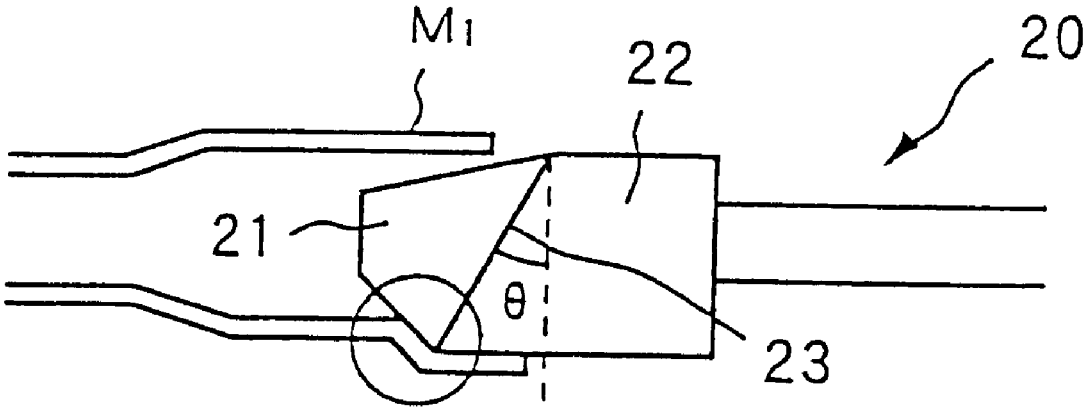
FIG. 3A is a schematic view depicting an eccentrically expanding step of the newly proposed method, wherein an eccentrically expanding punch is forcibly inserted into a coaxially expanded open end.
Figure 3B:
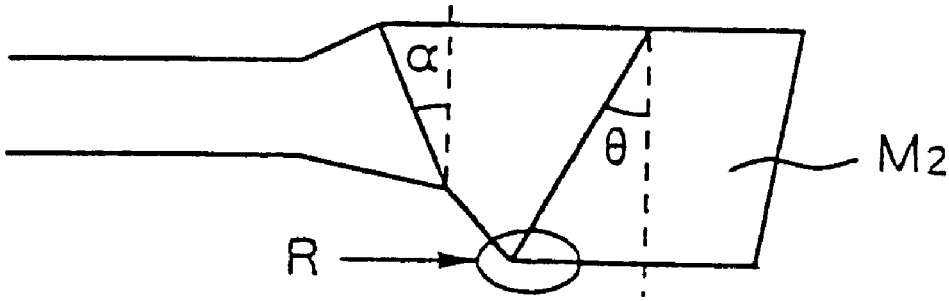
FIG. 3B is a view illustrating an eccentrically expanded open end of a metal pipe.

An eccentrically expanding punch 20, which has a boundary 23 between a conical tip 21 and a cylindrical body 22 inclined with a predetermined angle θ with respect to a radial direction of the coaxially expanded metal pipe $M_1$, is used in the following eccentrically expanding step, as shown in FIG. 3A. When the punch 20 is forcibly inserted into the coaxially expanded open end $M_1$, the conical tip 21 comes in contact with an inner wall at the side to be eccentrically expanded earlier than the side to be expanded without eccentricity.

When the punch 20 with an inclination angle θ is forcibly inserted into the coaxially expanded open end $M_1$, a periphery of the cylindrical body 22 comes in contact with an inner wall of the coaxially expanded open end $M_1$ at the side to be eccentrically expanded earlier than the opposite side to be expanded without eccentricity. As the punch 20 advances into the open end $M_1$, the contact plane of the cylindrical body 22 extends to the side to be expanded without eccentricity. That is, an inner wall of the coaxially expanded open end $M_1$ is pressed with the cylindrical body 22 in such a manner that deformation of the side to be eccentrically expanded is contacted prior to the opposite side to be expanded without eccentricity.

Consequently, deformation-resistance of the wall is bigger at the side to be eccentrically expanded than the side to be expanded without eccentricity. Metal flow at the side to be eccentrically expanded is suppressed by the cylindrical body 22 of the punch 20 during eccentrically expanding, but metal is stretched at the side to be expanded without eccentricity and left to flow toward the side to be eccentrically expanded. As a result, the coaxially expanded open end $M_1$ is plastically deformed to an eccentrically expanded state $M_2$ having wall thickness uniform along a circumferential direction without partial reduction of wall thickness at the decentered side.

EXAMPLE

A high frequency-welded metal pipe of 25.4 mm in outer diameter, 1.0 mm in wall thickness and 350 mm in length was used as an original metal pipe M. An open end of the original metal pipe M is plastically deformed to a coaxially expanded state $M_1$ by forcibly inserting a coaxially expanding punch 10 into the open end of the original metal pipe M. Thereafter, the coaxially expanded open end $M_1$ was plastically deformed to an eccentrically expanded state $M_2$, by forcibly inserting an eccentrically expanding punch 20 into the coaxially expanded open end $M_1$. The open end of the original metal pipe M was coaxially and then eccentrically expanded by the punches 10, 20 made of quench-hardened tool steel, to which a lubricant was spread, in four steps under the conditions shown in Table 1.

TABLE 1

WORKING STEPS UNTIL FORMATION OF ECCENTRICALLY EXPANDED OPEN END

| Combination of working patterns | steps for formation of a coaxially expanded open end | | steps for formation of an eccentrically expanded open end | |
|---|---|---|---|---|
| | a first step | a second step | a third step | a fourth step |
| an expanding ratio | 26.8% | 53.5% | 79.1% | 104.7% |
| Eccentricity | — | — | 3.25 mm | 6.5 mm |
| An Inventive Example | α:15 degrees | α:15 degrees | θ:−15 degrees | θ:−15 degrees |
| Comparative Example No. 1 | α:0 degrees | α:0 degrees | θ:−15 degrees | θ:−15 degrees |
| Comparative Example No. 2 | α:15 degrees | α:15 degrees | θ:0 degrees | θ:0 degrees |

α:an inclination angle of a boundary of a coaxially expanding punch
θ:an inclination angle of a boundary of an eccentrically expanding punch In the case where the original metal pipe M is expanded by a coaxially expanding punch 10 with an inclination angle α, the coaxially expanded open end $M_1$ is preferably eccentrically expanded by a punch 20 having a boundary 23 inclined with an angle θ opposite to the inclination angle α of the coaxially expanding punch 10. The inclination angle θ is preferably the same in the opposite direction to the inclination angle α.

After the original metal pipe M was eccentrically expanded at its open end, the eccentrically expanded open end $M_2$ was observed to research the configuration and thickness distribution. Results are shown in Table 2. The work shows that the metal pipe $M_2$ of Inventive Example, wherein the open end was eccentrically expanded after formation of a coaxially expanded open end $M_1$ differentiated in axial wall length as $L_1<L_2$, had sufficient wall thickness without thickness deviation or necking even at an eccentrically expanded side. Maximum reduction of wall thickness at the eccentrically expanded open end $M_2$ was controlled within a range of 25%.

The metal pipe $M_2$ of Comparative Example No. 1, whereby a coaxially expanded open end $M_1$ with $L_1=L_2$ was eccentrically expanded, had wall thickness heavily reduced to 31% at most at its eccentrically expanded side. Cracking or necking often occurred due to such the heavy reduction of wall thickness.

Even when a coaxially expanded open end $M_1$ differentiated in axial wall length as $L_1<L_2$ was eccentrically expanded by a punch 20 having a non-inclined boundary 23 between a conical tip 21 and a cylindrical body 22, maximum reduction of wall thickness was still heavy as 33% at an eccentrically expanded open end $M_2$, as noted in Comparative Example No. 2. Cracks or necking was also detected in some cases.

It is clearly noted from comparison of Inventive Example with Comparative Examples that an eccentrically expanded open end $M_2$ is effectively formed without partial reduction of wall thickness along a circumferential direction, by combination of a coaxially expanding step(s) to plastically deform an open end of an original metal pipe M to a coaxially expanded state with $L_1<L_2$ with an eccentrically expanding step(s) using an eccentrically expanding punch 20 having a cylindrical body 22, which will come in contact with an inner wall of the coaxially expanded open end $M_1$ at a side to be eccentrically expanded earlier than the opposite side to be expanded without eccentricity. Since partial reduction of wall thickness is suppressed along a circumferential direction, the eccentrically expanded metal pipe $M_2$ can be used as a product free from defects such as cracks or necking. Such the combination of the coaxially expanding step(s) with the eccentrically expanding step(s) is especially effective for formation of an eccentrically expanded open end $M_2$ with an outer diameter twice or more compared with the original pipe M, as noted in Examples.

TABLE 2

CONFIGURATION OF AN ECCENTRICALLY EXPANDED OPEN END AND OCCURRENCE OF DEFECTS

| | Inventive | Comparative Examples | |
|---|---|---|---|
| | Example | No. 1 | No. 2 |
| maximum reduction (%) of wall thickness at an eccentrically expanded open end $M_2$ | 25 | 31 | 33 |
| occurrence frequency (/pieces) of cracks | 0/100 | 7/100 | 15/100 |
| occurrence frequency (/pieces) of necking | 0/100 | 14/100 | 22/100 |

According to the present invention as above-mentioned, an open end of an original metal pipe is plastically deformed to a coaxially expanded state differentiated in axial wall length at a side to be eccentrically expanded longer than the opposite side to be expanded without eccentricity, and then to an eccentrically expanded state by an eccentrically expanding punch having a cylindrical body, which comes in contact with an inner wall of the coaxially expanded open end at the former side earlier than the opposite side. Due to timing control of a contact plane of the punch with the inner wall, metal flow from the opposite side to the former side is promoted in the eccentrically expanding step, but reverse metal flow from the former side is restricted. Consequently, partial reduction of wall thickness is suppressed along a circumferential direction of the metal pipe, and a product has an eccentrically expanded open end of good configuration.

What is claimed is:

1. A method of manufacturing a metal pipe with an eccentrically expanded open end, which comprises the steps of:

forcibly inserting a coaxially expanding punch into an open end of an original metal pipe, so as to plastically deform said open end to a coaxially expanded state whereby a side to be eccentrically expanded is longer than the opposite side to be expanded without eccentricity along an axial direction of said original metal pipe;

withdrawing said coaxially expanding punch from said original metal pipe; and then forcibly inserting an eccentrically expanding punch, which has a boundary between a conical tip and a cylindrical body inclined with a predetermined angle with respect to a radial direction of said original metal pipe so that said cylindrical body comes in contact with an inner wall of the coaxially expanded open end at the side to be eccentrically expanded earlier than the opposite side to be expanded without eccentricity, into the coaxially expanded open end of said original metal pipe so as to plastically deform said open end to an eccentrically expanded state.

2. The method of manufacturing a metal pipe with an eccentrically expanded open end defined in claim 1, wherein the coaxially expanding punch has a boundary between a conical tip and a cylindrical body inclined with such an angle that a length of said cylindrical body along an axial direction of the original metal pipe is shorter at the side to be eccentrically expanded than the opposite side to be expanded without eccentricity, and the inclination of said boundary is opposite to the inclination of the boundary between the conical tip and the cylindrical body of the eccentrically expanding punch.

* * * * *

UNITED STATES PATENT AND TRADEMARK OFFICE

CERTIFICATE OF CORRECTION

PATENT NO. : 6,581,433 B2
DATED : June 24, 2003
INVENTOR(S) : Masato Otsuka et al.

It is certified that error appears in the above-identified patent and that said Letters Patent is hereby corrected as shown below:

Column 2,
Line 67, “angle a” should read -- angle α --.

Signed and Sealed this

Sixteenth Day of September, 2003

JAMES E. ROGAN
*Director of the United States Patent and Trademark Office*